US006352108B1

(12) United States Patent
Meyer et al.

(10) Patent No.: US 6,352,108 B1
(45) Date of Patent: Mar. 5, 2002

(54) WELL PIPE

(75) Inventors: Wilhelm Meyer, Lüneburg; Thomas D. Bloomfield, Neetze; Willi Keul, Kerpen, all of (DE)

(73) Assignee: Rheinbraun Aktiengesellschaft, Köln (DE)

( * ) Notice: Subject to any disclaimer, the term of this patent is extended or adjusted under 35 U.S.C. 154(b) by 0 days.

(21) Appl. No.: 09/437,080

(22) Filed: Nov. 9, 1999

(30) Foreign Application Priority Data

Nov. 18, 1998 (DE) ..... 198 53 211

(51) Int. Cl.[7] ..... E21B 12/00; E03B 3/12
(52) U.S. Cl. ..... 166/242.1; 138/124; 138/126
(58) Field of Search ..... 166/242.1; 308/174, 308/175, 176

(56) References Cited

U.S. PATENT DOCUMENTS 5,881,812 A * 3/1999 Malbrel et al. ..... 166/278

FOREIGN PATENT DOCUMENTS

| | | |
|---|---|---|
| DE | 1 301 300 | 5/1970 |
| DE | 7 020 888 | 10/1970 |
| DE | 1 784 288 | 8/1971 |
| DE | 1 786 014 | 11/1971 |
| DE | 7 206 442 | 5/1972 |
| DE | 25 30 370 | 1/1977 |

* cited by examiner

*Primary Examiner*—William Neuder
(74) *Attorney, Agent, or Firm*—Drinker Biddle & Reath LLP

(57) ABSTRACT

The invention is a well pipe with longitudinal rods arranged in intervals in the pipe wall over the whole circumference. It is characterized by the fact that the well pipe is made of polymer concrete, and of an additional layer of packed gravel functioning as a filter if designed as a well filter pipe, and that the rods are glass fiber rods which transfer axial tensile load.

30 Claims, 1 Drawing Sheet

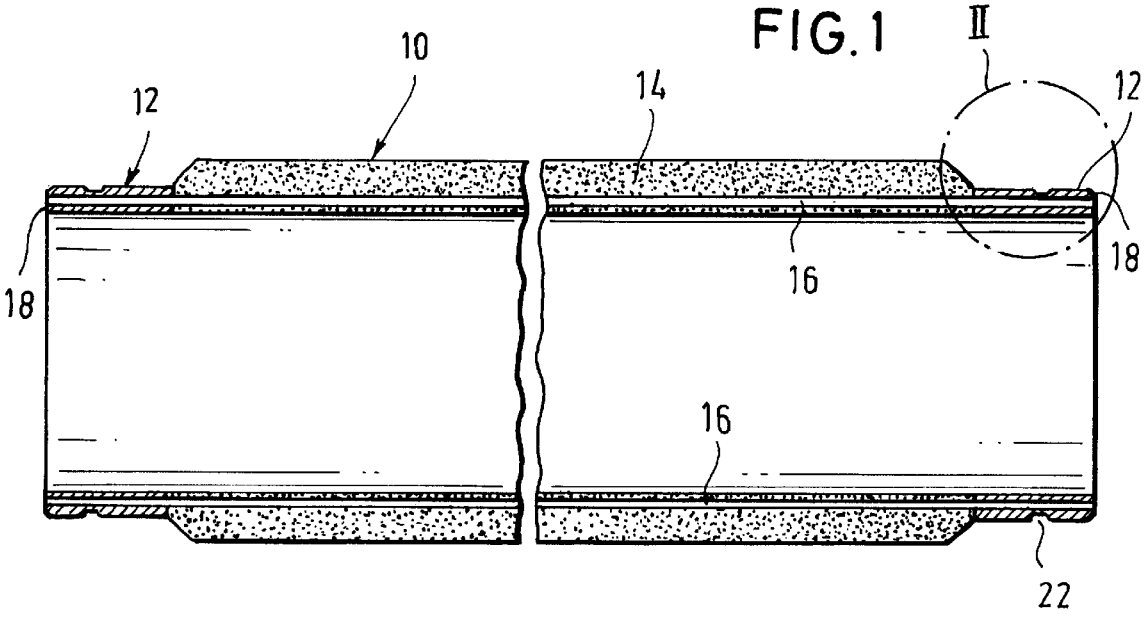
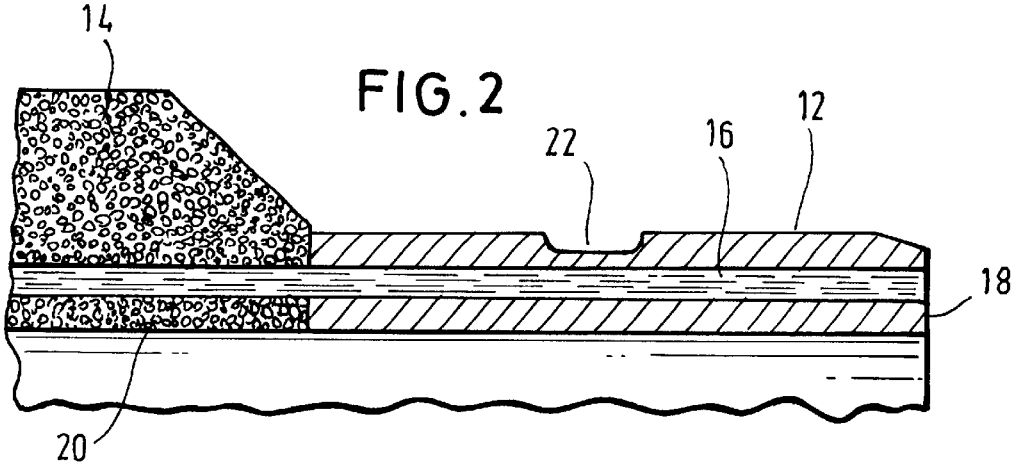
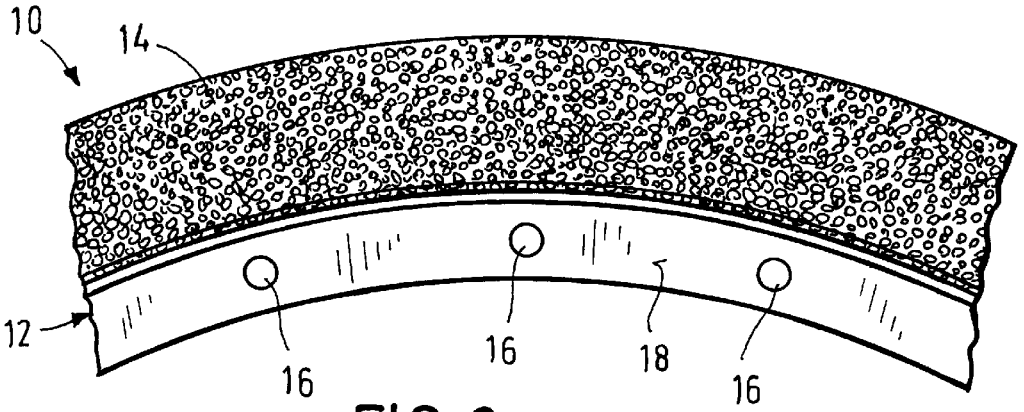
FIG. 3

WELL PIPE

This application claims foreign priority benefits under Title 35, United States Code §119(a)–(d) of German patent number 19853211.3-25 filed Nov. 18, 1998.

FIELD OF THE INVENTION

The invention is a well pipe as specified in the general description in claim 1.

BACKGROUND OF THE INVENTION

Coupling joints can be used to connect such well pipes to a run of pipe which can carry tensile load and is used for well casing. Individual pipes can be designed as filter pipes which are installed in the run of pipe in certain intervals.

DE-OS 25 30 370 discloses such a well pipe made of asbestos cement. Asbestos cement pipes have the advantage of being relatively lightweight on the one hand and being strong enough on the other hand to sustain the large tensile forces generated during the installation of a hanging pipe run in the well. The pipe run transfers the forces to the equipment in which it hangs during installation in the well.

Furthermore it a known procedure to equip such asbestos cement pipes with a filter body in order to use them as filter pipes. DE-PS 13 01 300 discloses such a filter pipe with a carrier pipe made of asbestos cement or plastic. It has a perforated wall structure carrying a filter layer on the outside which is made up of a layer of packed gravel. The perforation holes in the wall are necessary for water flowing through the filter layer to enter into the carrier pipe. Besides the known objections against the further use of asbestos cement pipes these known well filter pipes feature a disadvantage, which is the costs incurred by drilling the holes in the pipe wall. In addition the available filter area of these known pipes is significantly restricted by the wall sections of the carrier pipe between the perforation holes.

DE-OS 17 86 014 discloses a well filter pipe with a support structure designed as a cage or skeleton with an all-around layer of packed gravel. This invention assumes that the ends of the cage protrude over the gravel layer on both ends so that two neighbouring pipes can be connected. This known well filter pipe is relatively heavy since the support structure (cage, etc.) is obviously made of metal. Another disadvantage is that the existence of the support structure prohibits the easy removal of the pipe by an excavator bukket. This feature is especially important in cases where the well filter pipe is used for drainage, e. g. in open cast lignite mining, where the area will be excavated by a bucket wheel excavator later on.

DE-OS 17 84 288 describes a well filter pipe which can easily be removed by an excavator because it consists only of a packed gravel layer bound by resin. The pipe ends used for connections feature a higher resin content so that their strength is higher, too. Besides they have circular grooves around the circumference of the connection sections which, jointly with one connection sleeve for the neighbouring connection sections of each two pipes, form a channel into which a connection element, i. e. a length of sheathed steel rope, can be inserted. While these pipes are fit for unproblematic removal by an excavator bucket their resistance to tensile load is extraordinarily small, so that they are not fit for installation in a well in a hanging run of pipe.

Therefore the idea that led to the invention was to design a well pipe as described initially in such a way that it is lightweight and sufficiently strong to allow installation of a hanging run of pipe in a well without the need to use asbestos cement for its production. Besides that the manufacture of such a well pipe, even if designed as a filter pipe, should not be more complex or difficult than the manufacture of the known filter pipes.

SUMMARY OF THE INVENTION

This task is resolved by the combination of the features listed in claim 1.

The employment of resin-bound glass fiber rods allows the manufacture of well pipes with high tensile strength which are not significantly heavier than known well pipes made of e.g. asbestos cement without any reinforcement or support structures. In addition such glass fiber rods do not require any additional anti-corrosion measures. Given the suitable selection of the resin for the glass fiber rods on the one hand and for the polymer concrete and the layer of packed filter gravel on the other hand it is possible to establish a cohesive bond, an adhesive bond or a bond which is partially cohesive and partially adhesive, between the glass fiber rods and the according sections of the filter pipe. Consequently the well pipe functioning as a filter pipe is less heterogeneous altogether than traditional well filter pipes consisting, e.g., of a resin-bound gravel layer and a skeleton or frame made of steel. This lesser degree of heterogeneity has a particularly favourable effect when the well pipe is pre-stressed, because the homogeneous bonding between the resin-bound glass fiber rods and the layer of packed filter gravel, and with the polymer concrete pipe in the connection sections respectively, helps distribute the tensile load more evenly over the whole well filter pipe. The danger of delamination between the components that make up the pipe shell and the glass fiber rod is eliminated. The number and diameter of the glass fiber rods can be selected so as to achieve an optimum correlation between the total outer surface of the glass fiber rods, which is the surface connecting them with the surrounding polymer concrete or layer of packed filter gravel.

BRIEF DESCRIPTION OF THE DRAWINGS

The drawing shows the application of the invention in a well filter pipe.

FIG. 1 shows a longitudinal section of a well filter pipe

FIG. 2 shows a magnified detail from FIG. 1, i.e. an end section of the well filter pipe.

FIG. 3 shows part of the face of the well filter pipe in the same scale as in FIG. 2.

DESCRIPTION OF THE INVENTION

At each end the well filter pipe (10) has a relatively short connection section (12) made of polymer concrete. In between the ends there is section (14), a bonded gravel filter made up of filter gravel and polyester or vinyl ester resin. These resins can also be used as binders for the polymer concrete.

The well filter pipe (10) is equipped with resin-bound glass fiber rods (16) from one end face (18) to the other. These rods lienear the inner pipe wall (20). This is mainly due to the fact that in this application the well filter pipe (10) has a smaller wall thickness in the connection sections (12) than in the sections with the gravel filter (14).

The well filter pipe (10) is equipped with resin-bound glass fiber rods (16) from one end face (18) to the other. These rods lienear the inner pipe wall (20). This is mainly due to the fact that in this application the well filter pipe (10)

has a smaller wall thickness in the connection sections (12) than in the sections with the gravel filter (14).

The gravel filter (14) must have a minimum permeability requiring a pore volume of e.g. 36%. Therefore its compressive strength is significantly lower than the strength of the polymer concrete which makes up the connection sections (12). However, this fact is of lesser importance because the main issue is that the pipe be able to sustain and transfer tensile load during vertical installation of a hanging pipe run. The connection with each neighbouring pipe is either a partial positive connection or a total positive connection and can be established using a sleeve which lies around the connection sections of two neighbouring pipes. The positive connection between the sleeve, which is not shown here, and the connection section (12) is established by a steel rope or polyamide rod which is inserted in the groove (22) on the outside of connection section (12). In a pipe run consisting of several pipes the axial tensile load is transferred from pipe to pipe via these connection elements. Within individual pipes the axial tensile load is mainly transferred by the resin-bound glass fiber rods.

The pipes are manufactured in a mold which defines the outer and inner pipe surface. The cross-section of the mold is ring-shaped. First the glass fiber rods are arranged in the mold and prestressed, then the material for the lower connection section (12), the material for section (14) made up of filter gravel and the material for the upper connection section are filled in.

Before curing starts the material is compacted by means of a vibrator. For the gravel filter it is important to observe the desired pore volume.

For the production of well pipes without a filter layer, i.e. pipes totally made up of polymer concrete, a mold with a constant outer diameter over its whole length is used. Its diameter is identical with the diameter of the end connection sections (12) of the well filter pipe shown in FIGS. 1–3. Since the pipe is made up of polymer concrete over its whole length it is made by filling in only polymer concrete after arranging and pre-stressing the glass fiber rods.

In both the standard well pipe with full walls and the well filter pipe the axial tensile load is carried by the glass fiber rods. So the well pipe described in this invention can be used where known well pipes are also used, and in addition it is fit for removal by an excavator bucket. Of course the well pipe can also be employed where this feature does not play any role.

What is claimed is:

1. A well pipe with longitudinal rods arranged in the pipe wall in equal intervals over the pipe's whole circumference with the pipe wall made up of polymer-bound grave-type grains, which is characterized by the fact that the rods are resin-bound longitudinally pre-stressed glass fiber rods with bonding to the pipe wall.

2. A well pipe as described in claim 1 which is characterized by the fact that at both ends of the well pipe there is a connection section for a coupling element by means of which the well pipe can be linked with other well pipes to form a run of pipe that can bear tensile load.

3. A well pipe as described in claim 2 which is characterized by the fact that the two connection sections are made of polymer concrete with a filter made of polymer-bound gravel-type grains in between the two connection sections, with a higher polymer content in the connection sections than in the packed gravel filter section in between.

4. A well pipe as described in claim 3 which is characterized by the fact that the polymer content is about 10–15% in the connection sections and 4–7% in the filter layer.

5. A well pipe as described in claim 3 which is characterized by a bond between the resin-bound glass fiber rods and the filter layer.

6. A well pipe as described in claim 5 which is characterized by the fact that the bond between the resin-bound glass fiber rods and the filter layer is cohesive.

7. A well pipe as described in claim 5 which is characterized by the fact that the bond between the resin-bound glass fiber rods and the filter layer is adhesive.

8. A well pipe as described in claim 2 which is characterized by the fact that the connection sections feature grooves all around their circumference which can accept a connection element.

9. A well pipe as described in claim 1 which is characterized by the fact that the bonding between the fiber rods and the pipe wall is a cohesive and an adhesive bond.

10. A well pipe as described in claim 1 which is characterized by the fact that the bonding between the fiber rods and the pipe wall is a cohesive bond.

11. A well pipe as described in claim 1 which is characterized by the fact that the bonding between the fiber rods and the pipe wall is an adhesive bond.

12. A well pipe as described in claim 1 which is characterized by a design of the rod surface that gene-rates a positive connection between the rod surface and the polymer-bound gravel-type grains making up the well pipe and the connection sections and with the filter layer.

13. A well pipe as described in claim 1 which is characterized by the use of polyester resin as polymeric binder.

14. A well pipe as described in claim 1 which is characterized by the use of vinyl ester resin as polymeric binder.

15. A well pipe as described in claim 1 which is characterized by the rods reaching from one face end of the well pipe to the other.

16. A well pipe comprising polymer concrete with longitudinal rods arranged in the pipe wall in equal intervals over the pipe's whole circumference with the pipe wall made up of polymer-bound gravel-type grains, which is characterized by the fact that the rods are resin-bound longitudinally pre-stressed glass fiber rods with bonding to the pipe wall; and by the fact that at both ends of the well pipe there is a connection section for a coupling element by means of which the well pipe can be linked with other well pipes to form a run of pipe that can bear tensile load.

17. A well pipe as described in claim 16 which is characterized by the fact that the two connection sections are made of polymer concrete with a filter made of polymer-bound gravel-type grains in between the two connection sections, with a higher polymer content in the connection sections than in the packed gravel filter section in between.

18. A well pipe as described in claim 17 which is characterized by the fact that the polymer content is about 10–15% in the connection sections and 4–7% in the filter layer.

19. A well pipe as described in claim 17 which is characterized by the fact that the wall of the well pipe is thicker in the filter section than in the connection sections.

20. A well pipe as described in claim 17 which is characterized by a bond between the resin-bound glass fiber rods and the filter layer.

21. A well pipe as described in claim 20 which is characterized by the fact that the bonding between the fiber rods and the filter layer is a cohesive bond.

22. A well pipe as described in claim 20 which is characterized by the fact that the bonding between the fiber rods and the filter layer is an adhesive bond.

23. A well pipe as described in claim 16 which is characterized by a design of the rod surface that generates a positive connection between the rod surface and the polymer concrete making up the well pipe and the connection sections and with the filter layer.

24. A well pipe as described in claim 16 which is characterized by the use of polyester resin as polymeric binder.

25. A well pipe as described in claim 16 which is characterized by the use of vinyl ester resin as polymeric binder.

26. A well pipe as described in claim 16 which is characterized by the rods reaching from one face end of the well pipe to the other.

27. A well pipe as described in claim 16 which is characterized by the fact that the connection sections feature grooves all around their circumference which can accept a connection element.

28. A well pipe as described in claim 16 which is characterized by the fact that the bonding between the fiber rods and the pipe wall is a cohesive and an adhesive bond.

29. A well pipe as described in claim 16 which is characterized by the fact that the bonding between the fiber rods and the pipe wall is a cohesive bond.

30. A well pipe as described in claim 16 which is characterized by the fact that the bonding between the fiber rods and the pipe wall is an adhesive bond.

* * * * *